US006059632A

United States Patent [19]

Sassak

[11] Patent Number: 6,059,632

[45] Date of Patent: May 9, 2000

[54] HULA HOOP AND COUPLING MEMBER THEREFOR

[76] Inventor: Mark S. Sassak, 1340 Linden St., Plymouth, Mich. 48170

[21] Appl. No.: 09/338,673

[22] Filed: Jun. 22, 1999

[51] Int. Cl.[7] ..... A63H 1/00; A63H 33/00; F16B 7/00

[52] U.S. Cl. ..... 446/236; 446/28; 403/298; 403/314

[58] Field of Search ..... 446/26, 28, 236, 446/450; 273/336; 403/298, 292, 314, 300

[56] References Cited

U.S. PATENT DOCUMENTS

| | | |
|---|---|---|
| 3,729,860 | 5/1973 | Kargul . |
| 3,892,084 | 7/1975 | Hanysz . |
| 3,911,264 | 10/1975 | Chao . |
| 3,918,708 | 11/1975 | Augusta . |
| 4,006,556 | 2/1977 | Williams . |
| 4,052,982 | 10/1977 | Ozeryansky . |
| 4,215,510 | 8/1980 | Worrell . |
| 4,241,533 | 12/1980 | Newsome . |
| 4,352,255 | 10/1982 | Warehime . |
| 4,380,885 | 4/1983 | Komagata . |
| 4,898,392 | 2/1990 | Goletz . |
| 4,915,666 | 4/1990 | Maleyko . |
| 4,944,707 | 7/1990 | Silverglate . |
| 5,022,646 | 6/1991 | Kessler . |
| 5,078,637 | 1/1992 | McFarland . |
| 5,079,046 | 1/1992 | Kessler . |
| 5,092,809 | 3/1992 | Kessler . |
| 5,108,340 | 4/1992 | Farrow . |
| 5,120,261 | 6/1992 | Dietzman . |
| 5,224,652 | 7/1993 | Kessler . |
| 5,261,756 | 11/1993 | Kohn . |
| 5,303,932 | 4/1994 | Kessler . |
| 5,356,132 | 10/1994 | McEwan et al. . |
| 5,490,806 | 2/1996 | Spector . |
| 5,538,454 | 7/1996 | Kessler . |
| 5,569,134 | 10/1996 | Nordanger . |

*Primary Examiner*—Robert A. Hafer
*Assistant Examiner*—Laura Fossum
*Attorney, Agent, or Firm*—Harness, Dickey & Pierce, PLC

[57] ABSTRACT

A plastic hula hoop incorporating a decorative outer fabric and a coupling member for securing the free ends of the hula hoop together and the free ends of the decorative fabric within the interior area of each free end of the hula hoop. The coupling member forms a single piece plastic component having a pair of channels on opposite sides of the central portion. The channels accept the free ends of the fabric during assembly such that when the free ends of the plastic hoop portion are urged together, the free ends of the fabric are captured and held securely within the interior area of the plastic hoop portion of the hula hoop. The coupling member is especially well adapted to function with non-stretchable fabric such as nylon.

17 Claims, 2 Drawing Sheets

FIG 4
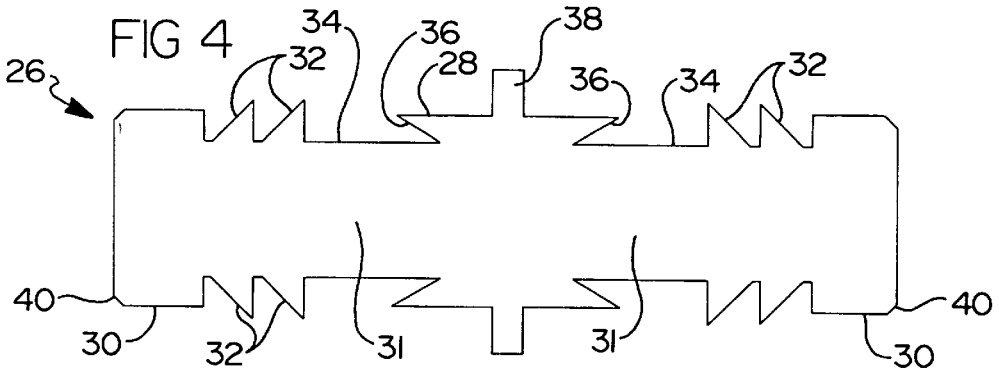
FIG 5
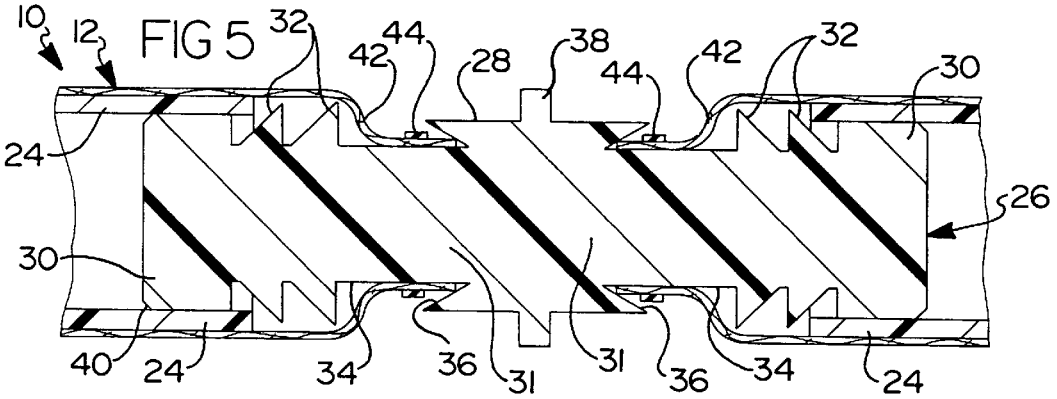
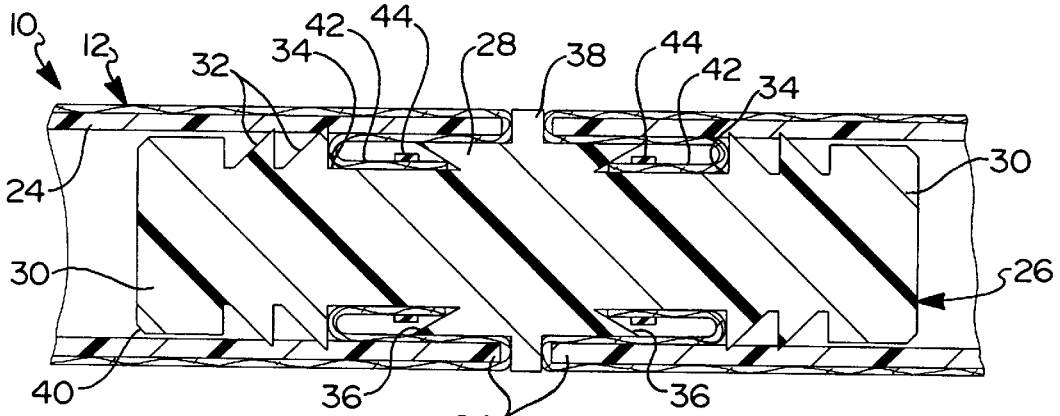
FIG 6

HULA HOOP AND COUPLING MEMBER THEREFOR

BACKGROUND OF THE INVENTION

1. Technical Field

This invention relates to toys and recreational products, and more particularly to a hula hoop having a coupling member adapted to secure the terminal ends of a plastic portion of the hoop together while retaining a decorative outer sheath within the interior free ends of the plastic portion of the hula hoop.

2. Discussion

Hula hoops have been used for a number of years to provide entertainment and enjoyment to individuals of all ages. Such products typically incorporate a circular, single piece plastic hoop having a pair of free terminal end portions. The end portions may be coupled together in a variety of ways to hold the free ends of the hula hoop together.

Recently, it has become popular to cover the plastic hoop portion of a hula hoop with some form of sheath or fabric having a decorative pattern thereon. However, the use of such a sheath or fabric can provide problems in securing the free terminal ends of the hoop together. Often some form of coupling member is inserted into each terminal end of the plastic portion of the hula hoop and adapted to engage the inner surface of the plastic hoop portion. However, with certain materials, for example, nylon, which is not stretchable, and which further has a relatively smooth outer surface, securing the free ends of the material within the terminal ends of the hoop can be difficult. In particular, the non-stretchability of nylon and its relatively smooth outer surface make it difficult for heretofore developed coupling members to sufficiently "grab" onto the nylon and hold it within the free terminal ends of the plastic hoop portion. The drawback, then, is that the free ends of the hoop are prone to become separated easily when attempting to secure them together with conventional coupling members.

It is therefore a principal object of the present invention to provide a hula hoop having a new and improved coupling member which is specifically adapted to retain the free ends of a fabric or sheath such as nylon, which is not stretchable, within the free terminal ends of the plastic hoop portion of the hula hoop.

It is a further object of the present invention to provide a coupling member for a hula hoop which comprises a single piece component, which is relatively easy to manufacture, and which does not require any special tools to be used when assembling the coupling member into the free ends of the plastic hoop portion of the hula hoop.

It is still another object of the present invention to provide a coupling member that functions extremely well to secure the free ends of a fabric or sheath which has been inserted over a plastic hoop portion of a hula hoop, where the fabric or sheath is made from nylon and is not stretchable and has a smooth outer surface.

It is further an object of the present invention to provide a coupling member for a hula hoop which is light in weight yet has high strength to resist twisting and bending forces, and which is specifically adapted to grasp a non-stretchable sheath or fabric covering a plastic inner hoop portion of a hula hoop to thereby secure the free ends of the nylon sheath or fabric within the interior of the plastic hoop portion.

SUMMARY OF THE INVENTION

The present invention relates to a hula hoop having a plastic hoop portion having a pair of free terminal ends, and a non-stretchable sheath or fabric covering at least a portion of the plastic hoop portion. In the preferred embodiment the fabric or sheath comprises a decorative nylon material having a length sufficient to extend about the entire length of the plastic hoop portion such that the free ends of the nylon may be tucked into the interior area of each free end of the plastic hoop portion.

The present invention further includes a unique coupling member. The coupling member is specifically adapted to engage each free end of the plastic hoop portion and to secure a portion of each free end of the fabric or sheath within one of the free ends of the plastic hoop portion. The coupling member holds the free ends of the fabric or sheath within the ends of the plastic hoop portion so that the free ends of the fabric or sheath cannot be easily separated during use of the hula hoop.

The coupling member includes a central portion and a pair of enlarged outer ends. A neck portion couples the central portion to each enlarged outer end and forms a channel on opposite sides of the central portion. Optionally, but preferably, at least one barb is formed adjacent each enlarged outer end to hold each end of the coupling member in its respective end of the plastic hoop portion once inserted therein.

In the preferred embodiment the coupling member also includes a raised circumferential rib projecting from the central portion. The raised circumferential rib has a height which permits it to be generally flush with the outer surface of the fabric or sheath once the coupling member is assembled within the free ends of the sheath, to thereby form a clean looking joint where the free ends of the hula hoop meet. In the preferred embodiment, the central portion of the coupling member includes vertical wall portions which diverge such that a sawtooth shaped edge is formed on each side of the central portion. This sawtooth shaped edge further facilitates grasping onto a free end of the fabric or sheath to prevent same from being pulled out of the interior of the plastic hoop portion when the hula hoop is in use.

BRIEF DESCRIPTION OF THE DRAWINGS

The various advantages of the present invention will become apparent to one skilled in the art by reading the following specification and subjoined claims and by referencing the following drawings in which:

FIG. 4 is an elevational side view of the coupling member shown in phantom in FIG. 3;

FIG. 5 is a cross sectional side view of the coupling member of FIG. 4 being assembled to the free ends of the fabric sheath and the free ends of the plastic hoop portion of the hula hoop of FIG. 1 before the free ends of the plastic hoop portion are urged towards each other; and FIG. 6 is a cross sectional side view of the coupling member assembled into the free ends of the plastic hoop portion in accordance with section line 6—6 in FIG. 1.

DETAILED DESCRIPTION OF THE PREFERRED EMBODIMENTS

Figure 1:
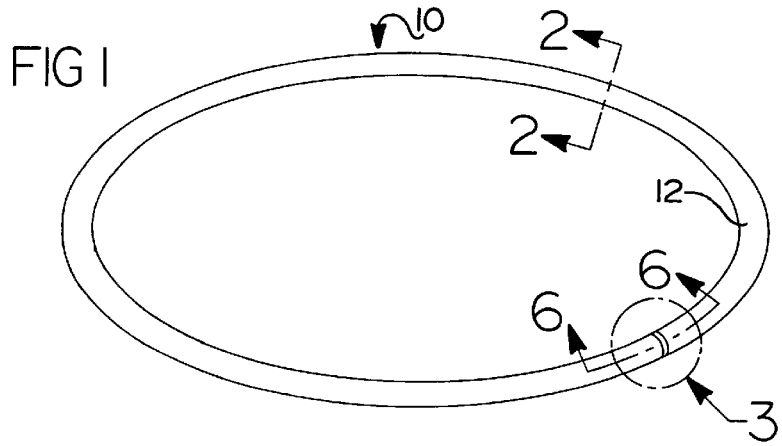
FIG. 1 is a perspective view of a hula hoop in accordance with a preferred embodiment of the present invention incorporating a decorative nylon sheath of material which extends around a major portion of the entire circumference thereof.
Figure 2:
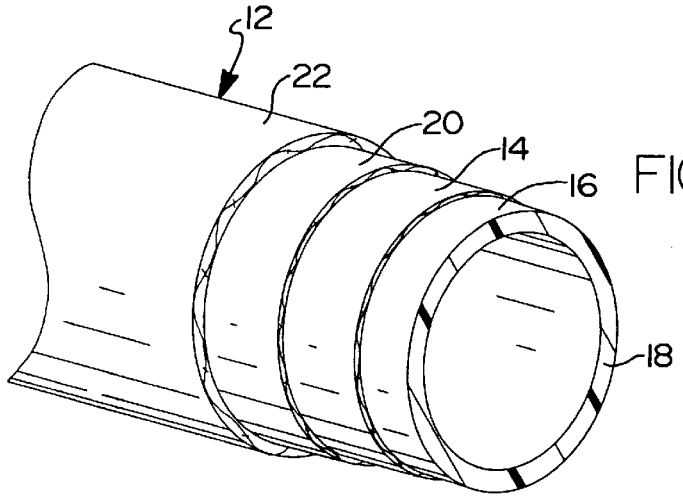
FIG. 2 is a cross sectional view of the hula hoop of FIG. 1 in accordance with section line 2—2 illustrating the preferred multi-layer nylon sheath.

Referring to FIG. 1, there is shown a hula hoop 10 in accordance with a preferred embodiment of the present invention. The hula hoop 10 is formed from a single length of high strength plastic and includes a decorative outer sheath or fabric preferably comprised of a non-stretchable material such as nylon 12. With brief reference to FIG. 2, in the preferred embodiment the non-stretchable fabric 12 is comprised of an inner layer of nylon 14 which is disposed over an outer surface 16 of a tubular plastic hoop portion 18 of the hula hoop 10. An intermediate layer of webbing 20 is disposed over the nylon layer 14, and a second nylon layer 22 is disposed over the intermediate layer of webbing 20. The resulting fabric 12 forms a very durable yet soft, decorative covering for the plastic hoop portion 18. The fabric 12 may be disposed about the entire circumference of the hoop 10 or about only a portion of the circumference such that other materials can be incorporated together with the fabric 12 to even further enhance the appearance and use of the hula hoop 10. One other such material is a grippable surface which is the subject of U.S. Pat. No. 5,851,161, assigned to the assignee of the present application, the disclosure of which is hereby incorporated by reference into the present application. This grippable surface disclosed in this patent may be disposed about the inner area of the hoop so that when the hula hoop 10 is in use the grippable surface provides a means by which the hoop can grip around the clothing of the user as the hoop is twirled about the waist or a limb of the user. It will be appreciated, however, that a wide variety of fabrics 12 could be used, and that the illustration of a multi-layer, non-stretchable nylon fabric is merely for exemplary purposes.

Figure 3:
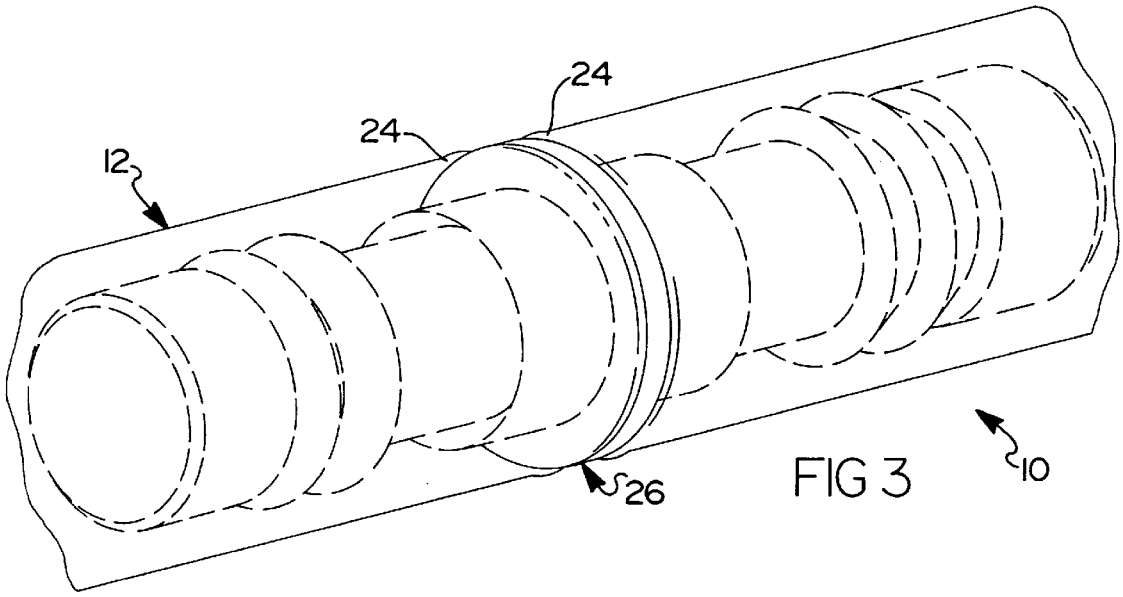
FIG. 3 is an enlarged portion of the hula hoop in accordance with circled area 3 in FIG. 1 illustrating a coupling member of the hula hoop in phantom within the plastic hoop portion of the hula hoop.

Referring briefly to FIG. 3, the plastic hoop portion 18 includes terminal or free ends 24 which, when joined together, form the circular hula hoop 10 shown in FIG. 1. The free ends 24 are joined together by a coupling member 26 which is inserted into each of the free ends 24 of the plastic hoop portion 18. As will be explained further in the following paragraphs, the coupling member 26 is particularly well adapted to engage the free ends of a non-stretchable fabric which are tucked into the interior of each free end 24 of the hula hoop 10 and to prevent the free ends from becoming pulled out of the free ends of the plastic hoop portion 18 during use of the hula hoop. The coupling member 26 makes assembly of the hula hoop 10 quick and easy and eliminates the need for any special tools or complicated assembly procedures.

Referring to FIG. 4, the coupling member 26 is shown. The coupling member 26 is preferably formed from a single length of high strength plastic through injection molding or other suitable processes. The coupling member 26 includes a central portion 28 spaced apart from a pair of outer, enlarged ends 30 by neck portions 31. One or more barbs 32 are preferably formed inwardly of each enlarged outer end 30. The neck portions help to form channels 34 on each side of the central portion 28. A vertical wall portion 36 on each side of the central portion 28 also diverges inwardly away from its respective outer enlarged outer end 30 such that it forms a sawtooth shaped edge. A raised circumferential shoulder 38 is disposed on the central portion 28. To ease insertion into each free end of the plastic hoop portion 18, each enlarged outer end 30 includes a tapered or beveled edge 40.

Referring to FIG. 5, assembly of the hula hoop 10 is accomplished by first securing the free ends 42 of the fabric 12 in the channels 34 of the coupling member 26. This is accomplished by placing a plastic tie or rubber band 44 tightly around each free end 42 of the fabric 12 such that the free end 42 is held tightly in its associated channel 34. The ties 44 may be conventional plastic ties commonly used to tie plastic trash bags. Adhesive tape could also be used for this function. The enlarged outer ends 30 are also inserted just slightly into the free ends 24 of the plastic hoop portion 18 just prior to the free ends 42 of the fabric 12 being secured in the channels 34.

Referring to FIG. 6, the free ends 24 of the plastic hoop portion 18 are then urged into contact with the raised shoulder 38. The channels 34 provide an area within which a small portion of each free end 42 of fabric 12 may be captured. The vertical wall portion 36 on each side of the central portion 28 of the coupling member 26 serves to "pinch", and thereby help capture, each free end 42 of fabric 12 within the interior area of the plastic hoop portion 18. The barbs 32 prevent the free ends 24 of the hoop portion 18 from being pulled apart readily during use of the hula hoop 10. The raised circumferential rib or shoulder 38 also serves to pinch the free ends 42 of the fabric 12 and provide a clean appearing junction for the free ends. The coupling member 26 is especially well suited for retaining non-stretchable fabrics such as nylon within the free ends 24 of the plastic hoop portion 18.

The coupling member 26 of the hula hoop 10 thus forms a means by which the free ends 24 of a plastic hoop portion may be securely held together, and also a means for securing a sheath or fabric, and particularly a non-stretchable fabric, within the ends of the plastic hoop portion of a hula hoop. The coupling member 26 is low in cost, easy to manufacture, and does not require special tools for assembling it into the free ends of a plastic hoop portion. While the coupling member 26 is shown as a single piece component, it will be appreciated that it could just as easily be formed as a multi-piece component held together by threads or other means. It will also be appreciated that while the use of a non-stretchable sheath is contemplated, that the coupling member will work just as well with stretchable fabrics or virtually any type of fabric.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A hula hoop, comprising:

a hoop generally forming a circle having an inner diameter sufficient to receive portion of a human body therethrough, said hoop having two terminal ends;

a decorative material sheath covering said hoop and having two terminal ends;

a coupling member adapted to accept said terminal ends of said sheath and to secure said terminal ends of said sheath within said terminal ends of said hoop;

said coupling member having a central portion and a pair of enlarged outer ends, each of said outer ends being spaced apart from said central portion by a neck portion forming a pair of channels on opposite sides of said central portion;

each of said two terminal ends of said sheath being disposed in an associated one of said channels before said two terminal ends of said hoop are joined adjacent one another; and said channels functioning to trap said two terminal ends of said sheath therein when said terminal ends of said hoop are slid toward one another over said central portion of said coupling member during assembly of said hula hoop.

2. The hula hoop of claim 1, further comprising a securing element adapted to be placed around one of said terminal ends of said sheath once said one terminal end of said sheath is placed in an associated one of said channels to hold said one terminal end securely in said channel as said terminal ends of said hoop are urged toward one another over said central portion of said coupling member.

3. The hula hoop of claim 1, further comprising a pair of said securing elements, with each one of said securing elements being used to secure one of said terminal ends of said sheath to its associated said channel prior to said terminal ends of said hoop being urged toward one another over said central portion of said coupling member.

4. The hula hoop of claim 1, wherein said central portion includes at least one vertical wall portion that diverges from its associated said enlarged outer end to form a sawtooth shaped notch.

5. The hula hoop of claim 1, wherein at least one of said enlarged outer ends includes at least one barb formed thereon for assisting in maintaining said one enlarged outer end within its associated said terminal end of said hoop.

6. The hula hoop of claim 1, wherein said coupling member comprises a single piece component formed from plastic.

7. The hula hoop of claim 1, wherein each said enlarged outer end includes at least one barb formed thereon for assisting in holding said outer ends within said terminal ends of said hoop.

8. The hula hoop of claim 2, wherein said securing element comprises a rubber band.

9. The hula hoop of claim 2, wherein said securing element comprises a plastic tie.

10. A hula hoop, comprising:

a hoop generally forming a circle having an inner diameter sufficient to receive a portion of a human body therethrough, said hoop having two terminal ends;

a decorative material sheath covering said hoop and having two terminal ends;

a coupling member adapted to accept said terminal ends of said sheath and to secure said terminal ends of said sheath within said terminal ends of said hoop;

said coupling member having a central portion and a pair of enlarged outer ends, each of said outer ends being spaced apart from said central portion by a neck portion forming a pair of channels on opposite sides of said central portion, said central portion further having a pair of wall portions on opposite sides thereof which each diverge from a vertical plane to form a sawtooth type notch on opposite sides of said central portion;

each of said two terminal ends of said sheath being disposed in an associated one of said channels before said two terminal ends of said hoop are joined adjacent one another and being secured within said channels by a pair of securing elements; and said channels functioning to trap said two terminal ends of said sheath therein when said terminal ends of said hoop are slid toward one another over said central portion of said coupling member during assembly of said hoop.

11. The hula hoop of claim 10, wherein at least one of said enlarged ends has at least one barb formed thereon to help secured said one enlarged end in an associated one of said terminal ends of said hoop.

12. The hula hoop of claim 10, wherein said coupling member comprises a single piece component formed from plastic.

13. The hula hoop of claim 10, wherein said securing elements each comprise a rubber band.

14. The hula hoop of claim 10, wherein said securing element comprises a plastic tie.

15. A hula hoop, comprising:

A hoop generally forming a circle having an inner diameter sufficient to receive a portion of a human body therethrough, said hoop having two terminal ends;

a decorative, non-stretchable sheath covering said hoop and having two terminal ends;

a coupling member adapted to accept said terminal ends of said sheath and to secure said terminal ends of said sheath within said terminal ends of said hoop;

said single piece, integrally formed coupling member having a central portion and a pair of enlarged outer ends, each of said outer ends having at least one barb thereon and being spaced apart from said central portion by a neck portion forming a pair of channels on opposite sides of said central portion, said central portion further having a pair of wall portions on opposite sides thereof which each diverge from a vertical plane to form a sawtooth type notch on opposite sides of said central portion;

each of said two terminal ends of said sheath being disposed in an associated one of said channels before said two terminal ends of said hoop are joined adjacent one another and being secured within said channels by a pair of securing elements; and said channels and said sawtooth notches functioning to trap said two terminal ends of said sheath within said terminal ends of said hoop when said terminal ends are slid toward one another over said central portion of said coupling member during assembly of said hoop.

16. The hoop of claim 15, wherein said coupling member is comprised of plastic.

17. The hoop of claim 15, wherein said central portion of said coupling member has a diameter which is less than a diameter of said enlarged ends.

* * * * *